US011952692B2

(12) United States Patent
Kallenbach et al.

(10) Patent No.: US 11,952,692 B2
(45) Date of Patent: Apr. 9, 2024

(54) STITCH-FORMING TOOL ASSEMBLY FOR A SEWING SYSTEM AND SEWING SYSTEM HAVING SUCH AN ASSEMBLY

(71) Applicant: PFAFF Industriesysteme und Maschinen GmbH, Kaiserslautern (DE)

(72) Inventors: Harald Kallenbach, Heltersberg (DE); Berthold Becker, Rimbach (DE); Stefan Samstag, Lorsch (DE)

(73) Assignee: PFAFF Industriesysteme und Maschinen GmbH, Kaiserslautern (DE)

( * ) Notice: Subject to any disclaimer, the term of this patent is extended or adjusted under 35 U.S.C. 154(b) by 88 days.

(21) Appl. No.: 17/785,442

(22) PCT Filed: Dec. 7, 2020

(86) PCT No.: PCT/EP2020/084822
§ 371 (c)(1),
(2) Date: Jun. 15, 2022

(87) PCT Pub. No.: WO2021/122086
PCT Pub. Date: Jun. 24, 2021

(65) Prior Publication Data

US 2023/0013197 A1 Jan. 19, 2023

(30) Foreign Application Priority Data

Dec. 17, 2019 (DE) ..... 10 2019 219 814.7

(51) Int. Cl.
*D05B 57/02* (2006.01)
*D05B 57/32* (2006.01)

(52) U.S. Cl.
CPC ..... *D05B 57/02* (2013.01); *D05B 57/32* (2013.01)

(58) Field of Classification Search
CPC ..... D05B 57/00; D05B 57/02; D05B 57/04; D05B 57/32
See application file for complete search history.

(56) References Cited

U.S. PATENT DOCUMENTS 1,323,340 A * 12/1919 Weis ..... D05B 85/00 112/222
1,924,378 A * 8/1933 Rattie ..... D05B 85/00 112/224

(Continued)

FOREIGN PATENT DOCUMENTS

CN 1136102 A 11/1996
CN 1173210 A 2/1998

(Continued)

*Primary Examiner* — Danny Worrell
(74) *Attorney, Agent, or Firm* — Smartpat PLC

(57) ABSTRACT

A stitch-forming tool assembly for a sewing machine is used to produce a double-chain stitch seam. A sewing needle of the assembly can be driven up and down in a needle stitching direction perpendicular to a material to be sewn and is designed to guide a needle thread. A looper of the assembly is designed to guide a looper thread and for oscillating movement in an oscillating movement plane. The latter is spanned by the needle stitching direction and by a sewing direction along the double chain stitch seam. During an entire double chain stitch a path of movement of the looper lies completely in the oscillating movement plane. This results in a stitch-forming tool assembly in which in particular a looper drive is simplified.

4 Claims, 4 Drawing Sheets

(56) References Cited

U.S. PATENT DOCUMENTS

| | | | | | |
|---|---|---|---|---|---|
| 3,916,808 | A | * | 11/1975 | Cassinelli | D05B 23/008 112/63 |
| 3,954,072 | A | | 5/1976 | Zocher | |
| 4,169,422 | A | * | 10/1979 | Hayes | D05B 57/04 112/201 |
| 4,233,917 | A | * | 11/1980 | Carnaby | D05C 15/22 112/222 |
| 4,344,375 | A | | 8/1982 | Tolle | |
| 4,385,575 | A | * | 5/1983 | Weber | D05B 85/02 223/102 |
| 4,458,614 | A | * | 7/1984 | Iwashita | D05B 85/00 112/222 |
| 4,539,923 | A | * | 9/1985 | Long | D05B 85/02 112/224 |
| 4,563,961 | A | | 1/1986 | Beyer et al. | |
| 5,189,966 | A | | 3/1993 | Satterfield | |
| 5,769,018 | A | | 6/1998 | Nakano | |
| 6,095,069 | A | | 8/2000 | Tadzhibaev | |
| 6,318,280 | B1 | | 11/2001 | Vornholt | |
| 2015/0267333 | A1 | | 9/2015 | Shomura | |
| 2023/0013197 | A1 | * | 1/2023 | Kallenbach | D05B 57/02 |

FOREIGN PATENT DOCUMENTS

| | | | |
|---|---|---|---|
| CN | 1199326 | A | 11/1998 |
| CN | 2853853 | | 1/2007 |
| CN | 101429708 | A | 5/2009 |
| CN | 101545182 | A | 9/2009 |
| CN | 104928858 | A | 9/2015 |
| DE | 104963 | C | 5/1897 |
| DE | 667052 | C | 11/1938 |
| DE | 111102 | A1 | 1/1975 |
| DE | 2650352 | B1 | 4/1978 |
| DE | 2901582 | A1 | 8/1979 |
| DE | 3935779 | C1 | 11/1990 |
| EP | 0126995 | A2 | 12/1984 |
| EP | 1943382 | A2 | 7/2008 |
| GB | 703934 | A | 2/1954 |
| JP | 2007117366 | A | 5/2007 |
| JP | 2008253448 | A | 10/2008 |
| JP | 2010227219 | A | 10/2010 |
| WO | 2007030809 | A2 | 3/2007 |

* cited by examiner

STITCH-FORMING TOOL ASSEMBLY FOR A SEWING SYSTEM AND SEWING SYSTEM HAVING SUCH AN ASSEMBLY

CROSS-REFERENCES TO RELATED APPLICATIONS

This application claims the priority of German Patent Application, Serial No. DE 10 2019 219 814.7, filed Dec. 17, 2019, the content of which is incorporated herein by reference in its entirety as if fully set forth herein.

FIELD OF THE INVENTION

The invention relates to a stitch-forming tool assembly for a sewing system for producing a double chain stitch seam. Further, the invention relates to a sewing system having such an assembly.

BACKGROUND OF THE INVENTION

A double chain stitch sewing machine is known from DD-PS 1111 02. An adjustment apparatus for a sewing machine looper is known from DE 29 01 582 C2. DE-PS 104 963 discloses a device for extending thread loops on double chain stitch machines. DE 39 35 779 C1 discloses a looper throwout apparatus on a sewing machine. U.S. Pat. No. 6,095,069 discloses a double chain stitch sewing machine. DE-PS 667 052 discloses a sewing needle with a thread cutting edge.

SUMMARY OF THE INVENTION

It is an object of the present invention to further develop a stitch-forming tool assembly of the type mentioned above in such a way that, in particular, a looper drive is simplified.

This object is achieved according to the invention by a stitch-forming tool assembly for a sewing system for producing a double chain stitch seam, having a sewing needle which can be driven up and down in a needle stitching direction perpendicular to a material to be sewn and is designed to guide a needle thread, having a looper designed to guide a looper thread and for oscillating movement in an oscillating movement plane which is spanned by the needle stitching direction and by a sewing direction along the double chain stitch seam, wherein a path of movement of the looper lies completely in the oscillating movement plane during an entire double chain stitch, wherein a central longitudinal axis of the sewing needle is spaced from a needle point of the sewing needle.

According to the invention, it has been found that it is not absolutely necessary to provide a path of movement of a looper in a double chain stitch sewing system, in which the looper performs an evasive movement relative to the sewing needle perpendicular to an oscillating movement plane of the looper. DD-PS 1111 02 and DE 29 01 582 C2 show prior art looper drives which provide such an elliptical evasive path of movement and have a correspondingly complex design. A correspondingly complex drive can be dispensed with in the assembly according to the invention.

In the assembly according to the invention, the sewing direction lies in the oscillating movement plane of the looper, which is also referred to as an inline system. The looper does not perform an evasive movement perpendicular to the oscillating movement plane. The stitch-forming tool assembly may be configured to not require a spreader finger for spreading a thread loop and correspondingly facilitating threading into the thread loop. Such a spreader finger, which may be dispensed with herein, is known by obvious prior use from a chain stitch sewing machine of the type Pfaff 5626.

A central longitudinal axis of the sewing needle is spaced from a needle point of the sewing needle. Such spacing of the sewing needle central longitudinal axis from the needle point enables an orientation of the sewing needle relative to the looper, which facilitates an obstruction-free relative movement of these stitch-forming components during the stitch-forming sequence.

In the assembly according to the invention, the needle can also be designed in such a way that it moves up and down exclusively in exactly one direction, i.e. in the needle stitching direction, i.e. it does not perform any evasive movement relative to the looper.

This is particularly true for the designs configured such that, when the sewing needle is mounted, the needle point is spaced from the central longitudinal axis perpendicularly to the oscillating movement plane, or comprising an embodiment such that when the looper passes the needle point during stitch formation, the central longitudinal axis lies between the needle point and the looper.

A sewing system comprising an embodiment such that when the looper passes the needle point during stitch formation, the central longitudinal axis lies between the needle point and the looper has those advantages already explained above with reference to the stitch-forming tool assembly. The sewing system may include a sewing machine or a sewing automat of which the stitch-forming tool assembly forms a part. The sewing system may also include a robot which can move a sewing head with the stitch-forming tool assembly in several degrees of freedom in a controlled/regulated manner so that even complex geometries of material to be sewn can be provided with defined seams, in particular with seams that run three-dimensionally in space. The sewing system can therefore be a sewing robot whose sewing head can be displaced by several degrees of freedom of translation or rotation, or a sewing machine.

An embodiment of the invention is explained in more detail below with reference to the drawing.

DESCRIPTION OF THE PREFERRED EMBODIMENT

Figure 1:
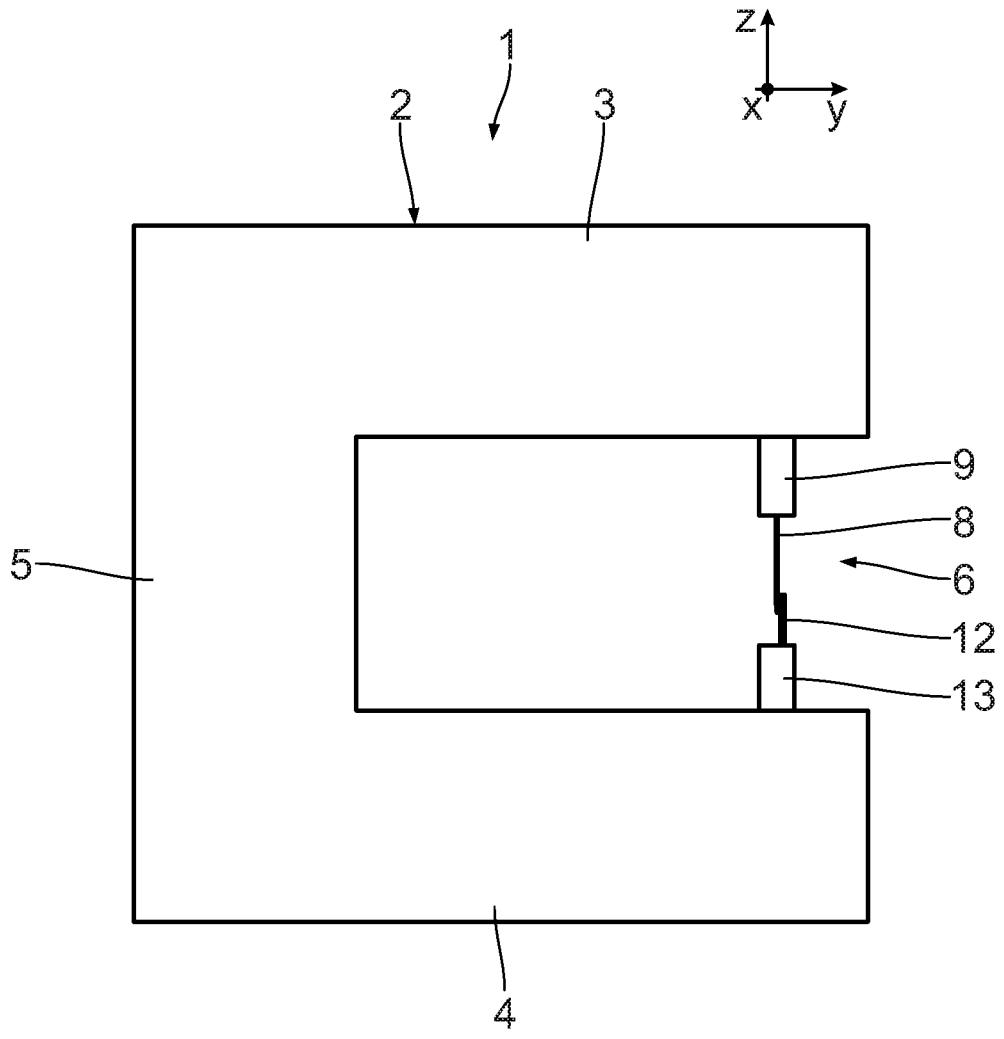
FIG. 1 shows a very schematic side view of a sewing system in the form of a sewing robot with indicated stitch-forming components for producing a double chain stitch seam.

FIG. 1 shows strongly schematic main components of a sewing system 1, designed as a sewing robot. The sewing system 1 has a C-shaped frame 2 including an arm 3, a base plate 4 and a stand 5 which connects the arm 3 to the base plate 4.

One component of the sewing system 1 can be a drive, not shown in more detail, by means of which the frame 2 can be displaced in several degrees of freedom of translation or rotation, for example in three, four, five or six degrees of freedom. Such a drive is known in connection with industrial robots. Accordingly, the sewing system 1 may be designed as a sewing robot.

FIG. 1 also shows a Cartesian xyz coordinate system to facilitate the arrangement of positional relations. The x-axis is perpendicular to the drawing plane in FIG. 1 and extends out of it. The y-axis in FIG. 1 runs to the right parallel to the extension of the arm 3 and the base plate 4. The z-axis in FIG. 1 runs upward parallel to the extension of the stand 5. The axis directions x, y, z, also apply to the following figures.

Figure 2:
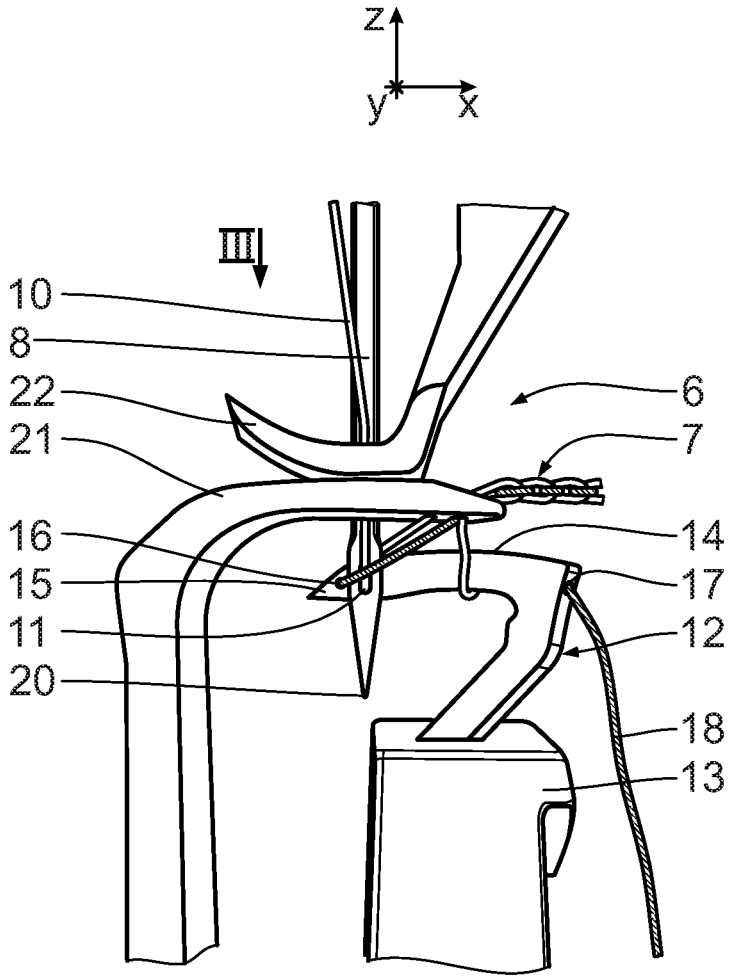
FIG. 2 in a view rotated by 90° about a z-axis compared to FIG. 1, shows the stitch-forming components together with a support for material to be sewn during the creation of a test seam, wherein a sewing needle guiding a needle thread is threading straight into a looper thread loop of a looper.
Figure 4:
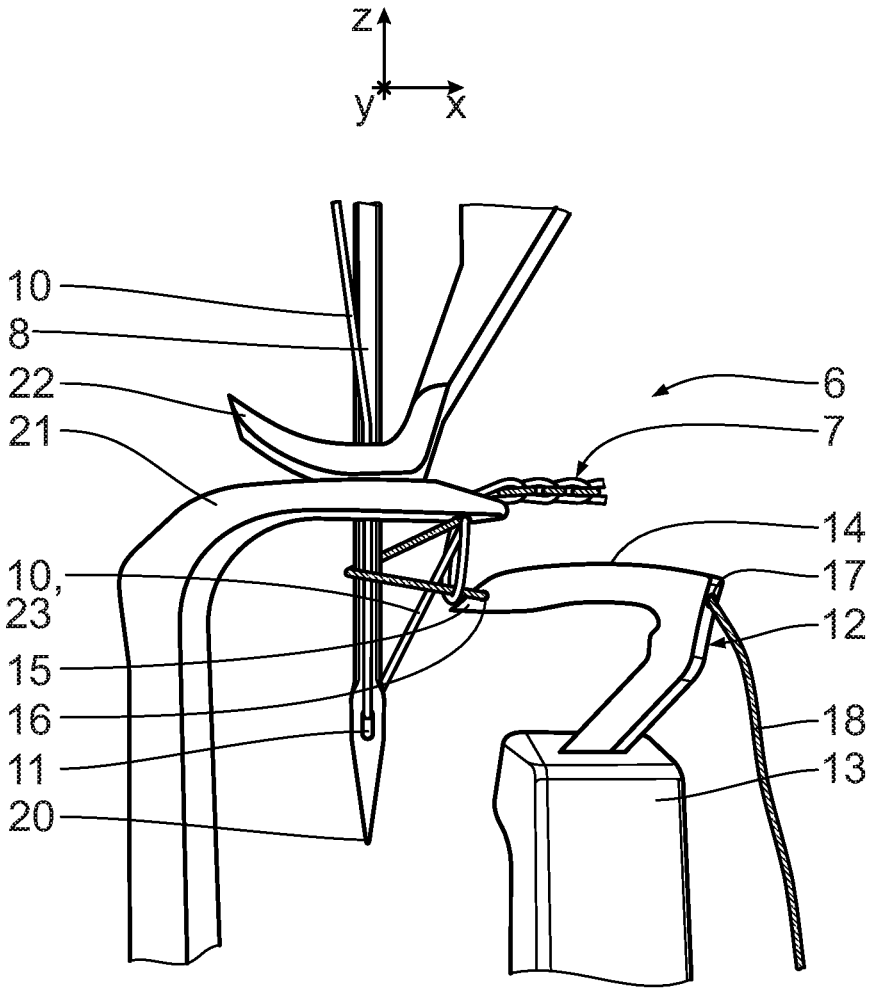
FIG. 4, 5 in illustrations similar to FIG. 2, show two further instantaneous relative positions of the stitch-forming tools to one another during a forming sequence of a double chain stitch of the test seam.
Figure 5:
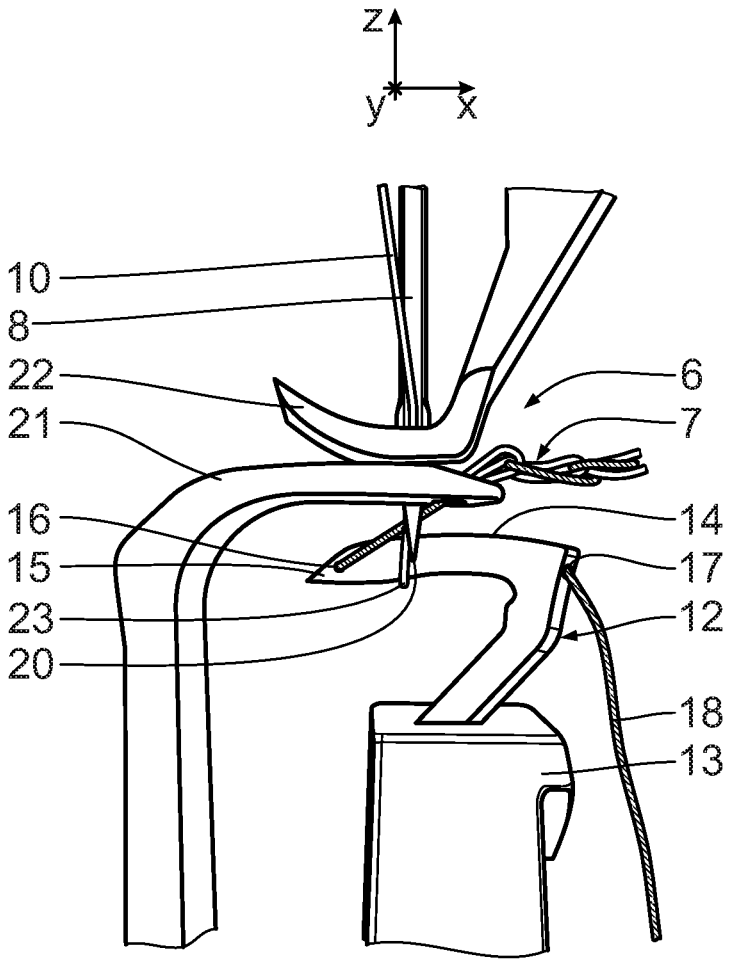

Part of the sewing system 1 is a stitch-forming tool assembly 6 for producing a double chain stitch seam 7, for which a pattern is shown in FIG. 2 and in FIGS. 4 and 5, respectively. A sewing direction runs along the x-direction, i.e. perpendicular to the yz-plane defined by the C-shape of the frame 2.

The assembly 6 has a sewing needle 8 which is held by a needle bar 9. The needle bar 9 and with it the sewing needle 8 can be driven up and down in a needle stitching direction along the z-axis perpendicular to a material to be sewn, not shown in the drawing. The sewing needle 8 is designed to guide a needle thread 10, which is also referred to as the upper thread. For this purpose, the sewing needle 8 has an eye 11.

The stitch-forming assembly 6 further includes a looper 12 which, in the side view according to FIGS. 2, 4 and 5, is hook-shaped and is carried by a driven looper carrier 13.

The looper 12 has an offset design. A threading section 14 of the looper 12, in the region of a looper tip 15 and at its opposite end, has a respective thread passage opening 16, 17 for a looper thread 18, which is also referred to as a lower thread. The looper 12 is designed to guide the looper thread 18. Due to a drive of the looper carrier 13, which is not shown in more detail, the looper is also designed for oscillating movement in an oscillating movement plane which coincides with the xz plane, i.e. is spanned on the one hand by the needle stitching direction z and on the other hand by the sewing direction x along the double chain stitch seam 7. A path of movement of the looper lies completely in the oscillating movement plane xz during the entire double chain stitch, snapshots of which are shown in FIGS. 2, 4 and 5. Perpendicular to this oscillating movement plane xz, the looper 12 therefore does not perform any evasive movement.

Accordingly, the sewing direction x lies in the oscillating movement plane xz of the looper 12. The sewing system 1 thus represents an inline system.

The stitch-forming tool assembly 6 does not include a spreader finger. Such a spreader finger, which is not present here, is known, for example, by obvious prior use from a chain stitch sewing machine of the type Pfaff 5626.

Figure 3:
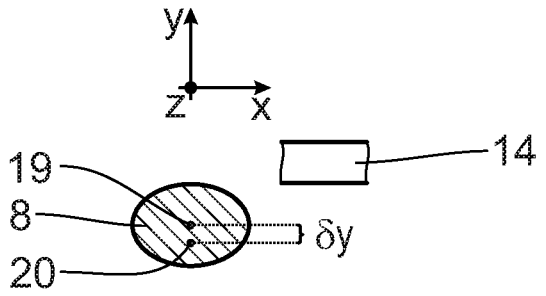
FIG. 3 shows a schematic top view onto the sewing needle and a section of the looper, seen from view direction III in FIG. 2.

FIG. 3 shows a schematic top view onto the sewing needle 8 and onto a brokenly depicted section of the threading section 14 of the looper 12. In particular with regard to the diameter of the sewing needle 8, the depiction according to FIG. 3 is enlarged. A viewing direction of FIG. 3 is along a central longitudinal axis 19 of the sewing needle 8. Also shown in FIG. 3 is a piercing spot of a needle point 20, through the drawing plane of FIG. 3. From this illustration, it can be seen that in the case of the sewing needle 8, the central longitudinal axis 19 is spaced from the needle point 20 by a distance δy. The sewing needle 8 is thus not rotationally symmetrical in the region of the needle point 20, but the needle point 20 is displaced by the distance δy with respect to an axis of symmetry of a basic needle body, which coincides with the central longitudinal axis 19. When the sewing needle 8 is mounted, as shown in FIG. 3, the needle point 20 is displaced perpendicular to the oscillating movement plane xz by the distance δy from the central longitudinal axis 19. When the threading section 14 of the looper 12 passes the needle point 20 during stitch formation, the central longitudinal axis 19 is located between the needle point 20 and the threading section 14 of the looper 12, i.e. between the needle point 20 and the looper 12, as also shown in FIG. 3.

This decentering of the needle point 20 makes it easier to guide the sewing needle 8 past the threading section 14, in particular when the needle point 20 is inserted into a loop of the looper thread 18 as shown in FIG. 2.

The threading section 14 is guided past a point section of the sewing needle 8 at a very small distance. In principle, the two components 8, 12 can also touch each other.

FIG. 2 also shows a support element 21 for the material to be sewn and a presser or transport foot 22 for the material to be sewn. In actual sewing operation, the material to be sewn is moved between the support element 21 and the foot 22 in the sewing direction x.

FIG. 4 shows the moment of the forming sequence of the double chain stitch at which the sewing needle 8 has arrived in the region of a bottom dead center. At the moment according to FIG. 4, the looper tip 15 is in the region of a right dead center in FIG. 4 and is deflected to such an extent that, in the projection according to FIG. 4, it has arrived beyond a section 23 of the needle thread 10 guided out of the eye 11.

FIG. 5 shows the moment of the stitch-forming sequence at which the threading section 14 is threaded into a needle thread loop formed in the meantime in the needle thread section 23 due to the reversal of the movement of the sewing needle 8, wherein the looper thread 18 is also guided through this loop of the needle thread section 23 in the region of the thread passage opening 16 of the threading section 14. During the next piercing (cf. FIG. 2) of a subsequent stitch-forming sequence, the sewing needle again pierces a loop of the looper thread 18 in the negative x-direction beyond this needle thread loop, and after the threading section 14 of the looper 12 has been retracted, the previously formed loop of the needle thread section 23, entangled with the looper thread 18, is thrown off the threading section 14, as can be seen in FIG. 4. This results in the familiar double chain stitch formation mechanism. The seam 7 thus formed runs in the positive x direction.

The assembly 6 can also be prepared as a conversion kit for a sewing system.

The invention claimed is:

1. A stitch-forming tool assembly (6) for a sewing system (1) for producing a double chain stitch seam (7), having a sewing needle (8) which can be driven up and down in a needle stitching direction (z) perpendicular to a material to be sewn and is designed to guide a needle thread (10), having a looper (12) designed to guide a looper thread (18) and for oscillating movement in an oscillating movement plane (xz) which is spanned by the needle stitching direction (z) and by a sewing direction (x) along the double chain stitch seam (7), wherein a path of movement of the looper (12) lies completely in the oscillating movement plane (xz) during an entire double chain stitch, wherein a central longitudinal axis (19) of the sewing needle (8) is spaced from a needle point (20) of the sewing needle (8) and wherein, when the looper (12) passes the needle point (20) during stitch formation, the central longitudinal axis (19) lies between the needle point (20) and the looper (12).

2. The stitch-forming tool assembly according to claim 1, wherein the sewing needle (8) is designed to move up and down exclusively in the needle stitching direction (z).

3. The stitch-forming tool assembly according to claim 2, wherein, when the sewing needle (8) is mounted, the needle point (20) is spaced from the central longitudinal axis (19) perpendicularly to the oscillating movement plane (xz).

4. A sewing system having a stitch-forming tool assembly according to claim 1.

* * * * *